US008925924B1

(12) United States Patent
Urban

(10) Patent No.: US 8,925,924 B1
(45) Date of Patent: Jan. 6, 2015

(54) FOOTBALL SIMULATION TABLE GAME DEVICE

(71) Applicant: Craig T. Urban, La Grange, TX (US)

(72) Inventor: Craig T. Urban, La Grange, TX (US)

( * ) Notice: Subject to any disclaimer, the term of this patent is extended or adjusted under 35 U.S.C. 154(b) by 0 days.

(21) Appl. No.: 13/969,136

(22) Filed: Aug. 16, 2013

(51) Int. Cl.
*A63F 7/00* (2006.01)
*A63F 7/06* (2006.01)
*A63F 9/00* (2006.01)

(52) U.S. Cl.
CPC ..... *A63F 7/0616* (2013.01); *A63F 7/0017* (2013.01)
USPC ..... 273/317.5; 273/108; 273/108.4; 273/247; 273/239; 273/120 R; 273/129 R; 273/441

(58) Field of Classification Search
CPC ..... A63F 7/0017; A63F 7/0616; A63F 9/02; A63F 7/249; A63F 7/06; A63F 7/068; A63F 7/0088; A63F 7/00
USPC ..... 273/317.5, 317.1, 317, 108.4, 108.41, 273/247, 317.9, 355, 356, 129 R, 120 R, 273/120 A, 129 W, 441, 442, 244
See application file for complete search history.

(56) References Cited

U.S. PATENT DOCUMENTS 395,261 A * 12/1888 Brooks ..... 273/120 R
487,825 A * 12/1892 Curtis et al. ..... 273/108.31
1,141,624 A * 6/1915 Fullerton ..... 273/247
1,701,655 A 2/1929 Andrews
1,990,809 A * 2/1935 Wright ..... 116/224
2,069,514 A * 2/1937 Wylie ..... 273/317.5
2,114,777 A * 4/1938 Englerth ..... 273/317
2,140,193 A * 12/1938 Weinberger ..... 273/317.5
2,263,115 A * 11/1941 Winter ..... 273/108.4
2,463,909 A * 3/1949 Ruch ..... 273/120 R
2,473,087 A * 6/1949 Ludwig ..... 273/129 R
2,600,940 A * 6/1952 Tullio ..... 116/222
2,760,776 A * 8/1956 Tullio ..... 273/317.5
3,315,962 A 4/1967 Budai
3,414,263 A 12/1968 Buchsieb
3,767,200 A * 10/1973 Lohr ..... 273/126 R
3,777,412 A * 12/1973 Lawlor et al. ..... 434/302
3,782,726 A * 1/1974 Huffman et al. ..... 273/108.41
3,851,878 A * 12/1974 Clarke ..... 273/108.41
5,074,557 A 12/1991 Broussard, Sr.
D474,814 S 5/2003 Conaway
7,325,807 B1 2/2008 Eason
7,717,431 B2 5/2010 Pettis

* cited by examiner

*Primary Examiner* — Sebastiano Passaniti

(57) ABSTRACT

A football simulation table game device is used for contests simulating American football. The device includes a slotted wall extending along a defensive end of a table. A defensive handle extends through the wall having a first end extending over a perimeter edge of the table. A defensive player form coupled to the defensive handle is selectively positionable between lateral sides of the table by manipulation of the defensive handle. Each of a plurality of rollers is coupled to a slope wherein the slope is moveable across the top surface of the table. An offensive handle is coupled to the slope to selectively adjust a position of the slope on the table. A sled is selectively couplable to the slope and slidable from a top end of the slope towards the defensive end of the table. An offensive player form is coupled to the sled.

19 Claims, 6 Drawing Sheets

FOOTBALL SIMULATION TABLE GAME DEVICE

BACKGROUND OF THE DISCLOSURE

Field of the Disclosure

The disclosure relates to table game devices and more particularly pertains to a new table game device for simulating American football in a table game permitting football type contests between opponents through manipulation of elements of the table game device.

SUMMARY OF THE DISCLOSURE

An embodiment of the disclosure meets the needs presented above by generally comprising a table having a top surface. A slotted wall extends upwardly along a defensive end of the table. A defensive handle is coupled to and extends through the wall having a first end being extended outwardly over a perimeter edge of the table. A defensive player form is coupled to a second end of the defensive handle and is selectively positionable between lateral sides of the table by manipulation of the defensive handle. Each of a plurality of rollers is coupled to a slope wherein the slope is moveable across the top surface of the table. An offensive handle is coupled to the slope to selectively adjust a position of the slope on the table. A sled is selectively couplable to the slope and slidable from a top end of the slope towards the defensive end of the table. An offensive player form is coupled to the sled.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
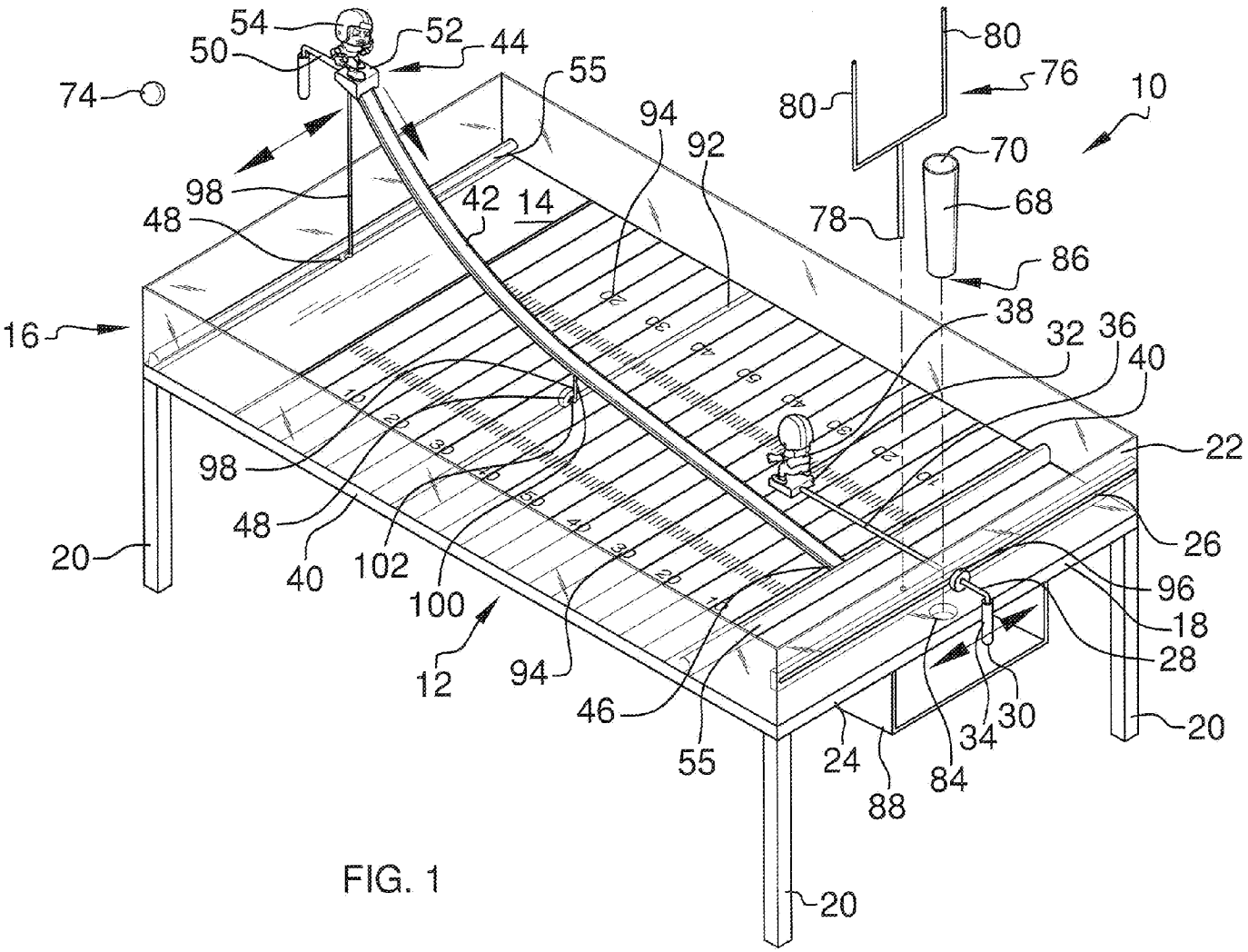
FIG. 1 is a top front side perspective view of a football simulation table game device according to an embodiment of the disclosure.
Figure 2:
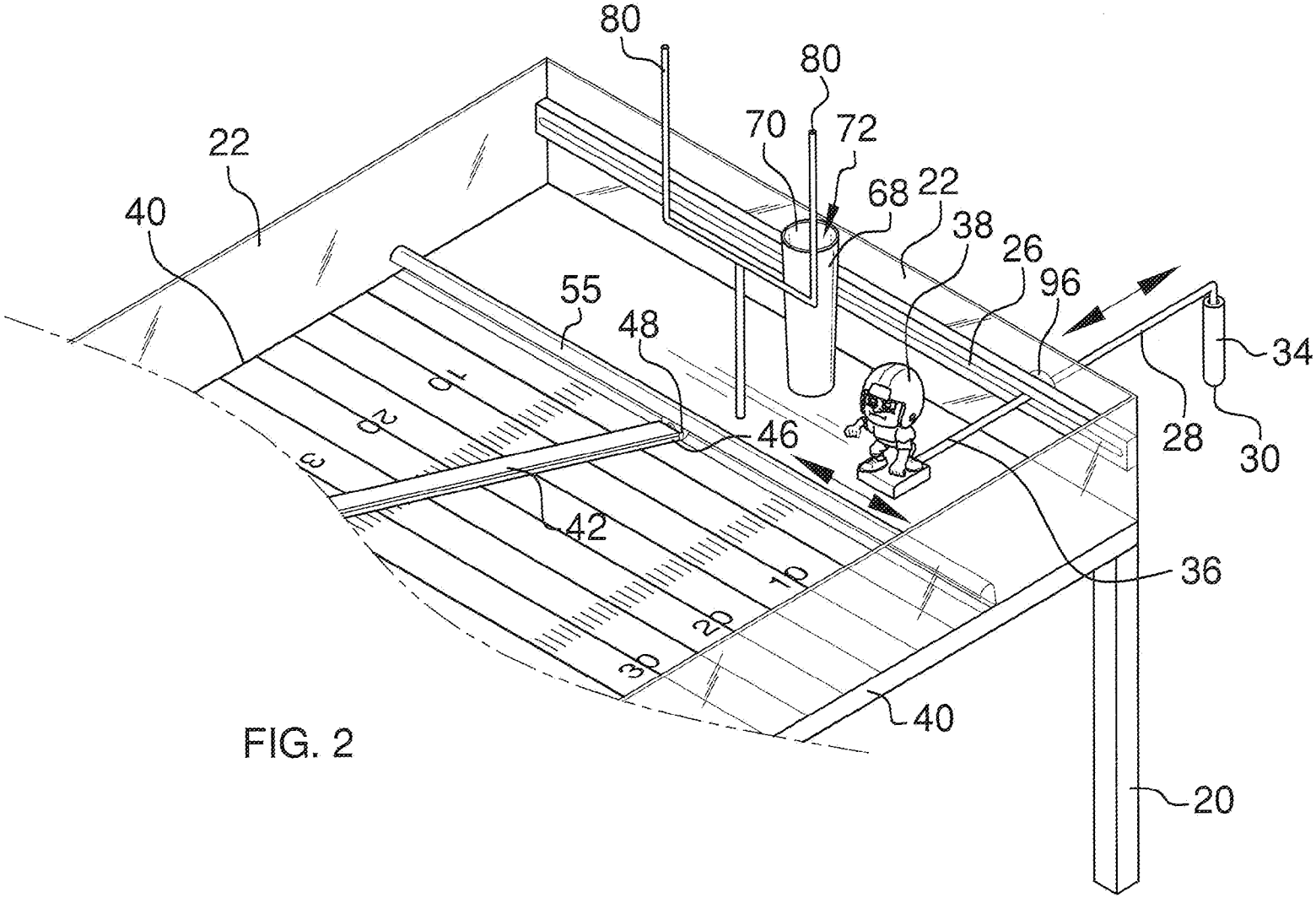
FIG. 2 is a partial top front side perspective view of an embodiment of the disclosure.
Figure 3:
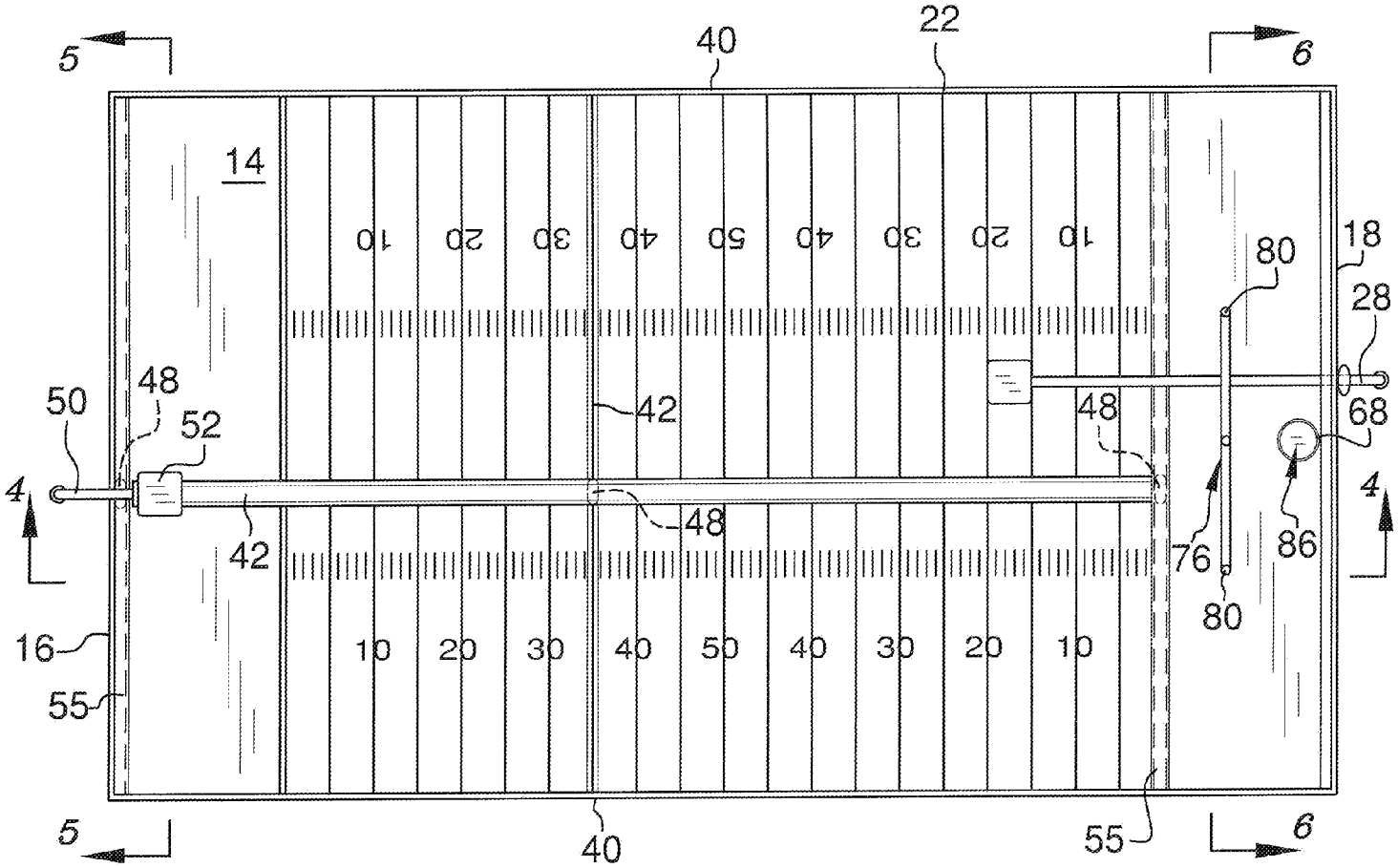
FIG. 3 is a top view of an embodiment of the disclosure.
Figure 4:
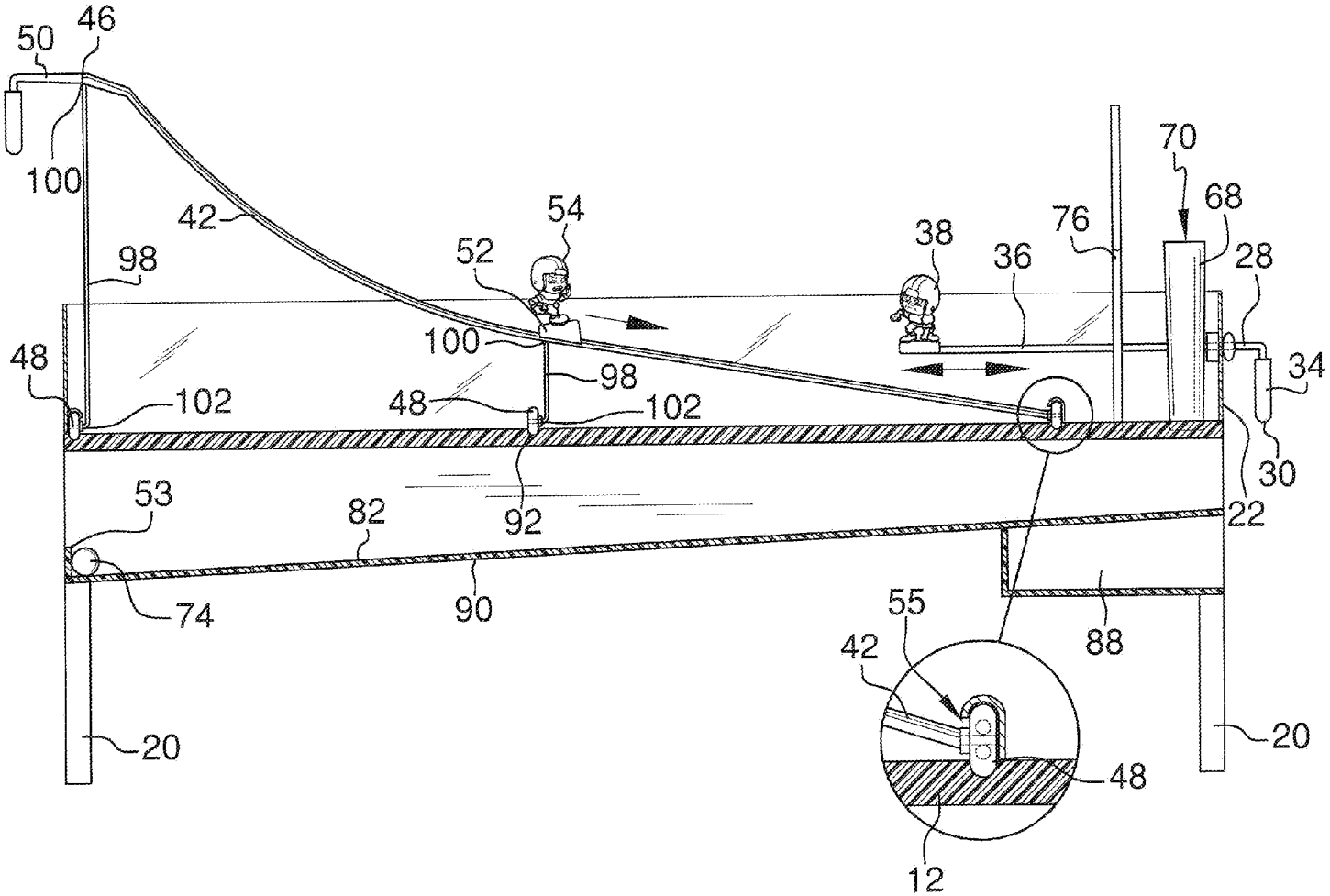
FIG. 4 is a cross-sectional view of an embodiment of the disclosure taken along line 4-4 of FIG. 3.
Figure 5:
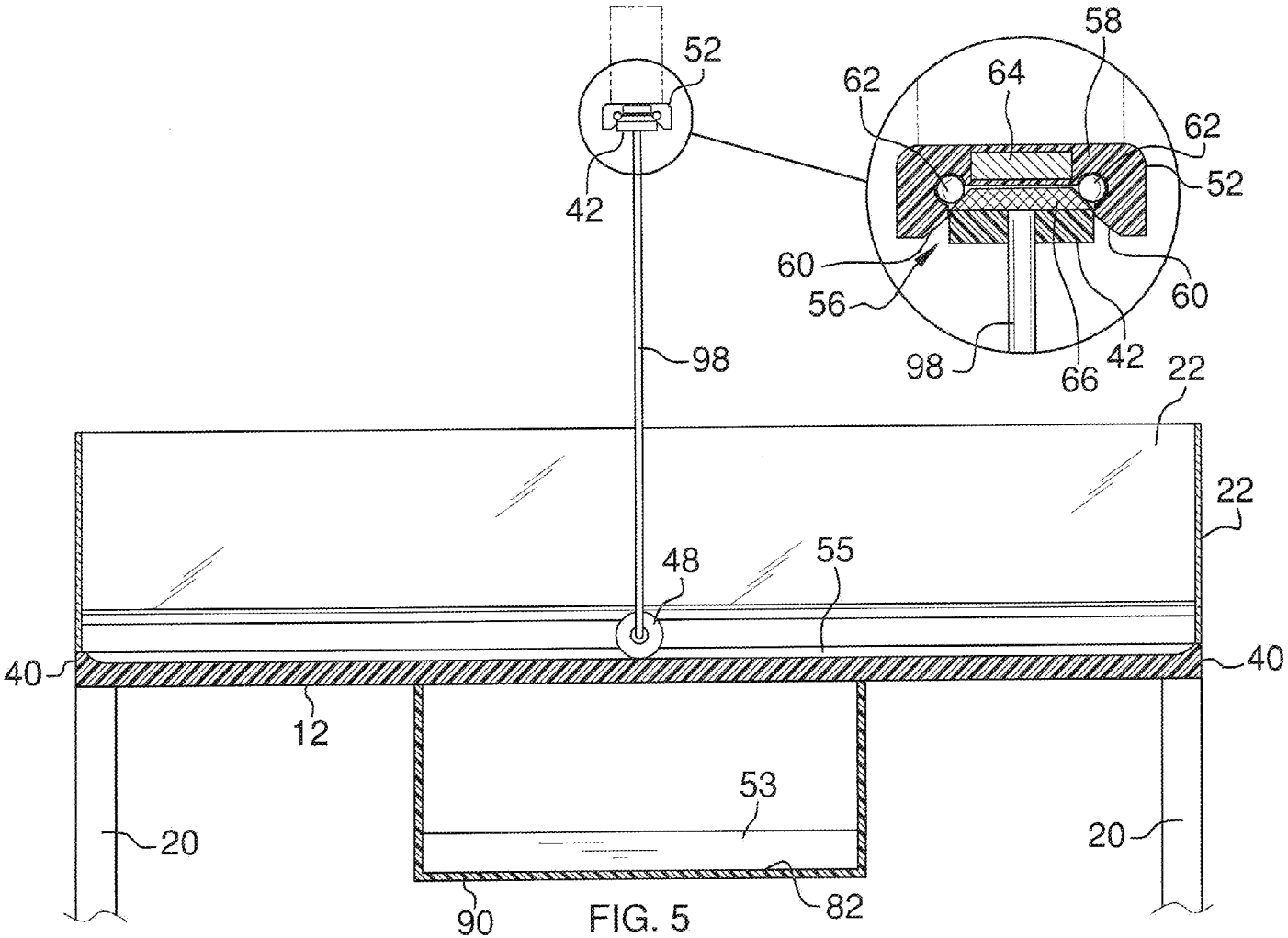
FIG. 5 is a cross-sectional view of an embodiment of the disclosure taken along line 5-5 of FIG. 3.
Figure 6:
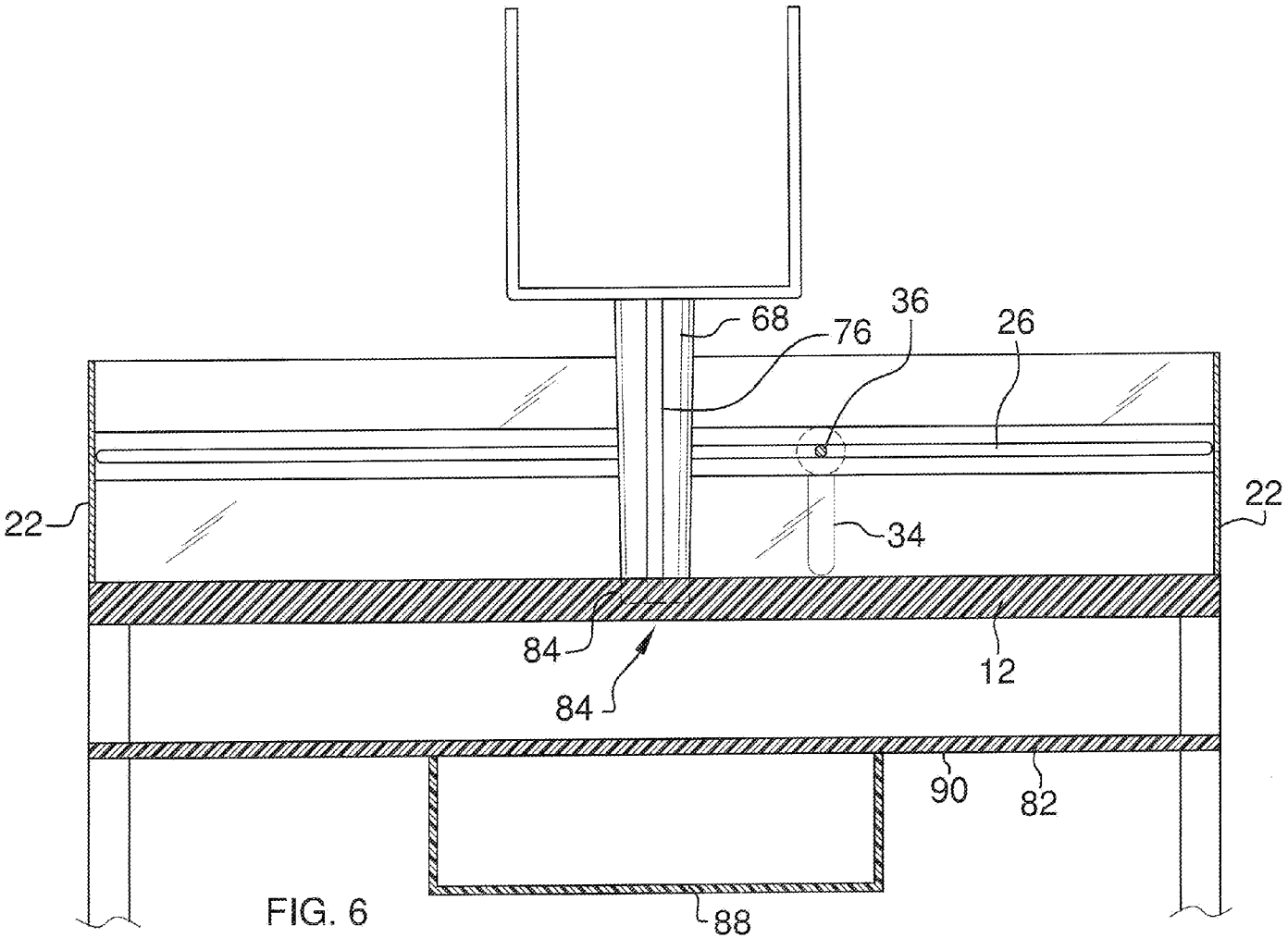
FIG. 6 is a cross-sectional view of an embodiment of the disclosure taken along line 6-6 of FIG. 3.

With reference now to the drawings, and in particular to FIGS. 1 through 6 thereof, a new table game device embodying the principles and concepts of an embodiment of the disclosure and generally designated by the reference numeral 10 will be described.

As best illustrated in FIGS. 1 through 6, the football simulation table game device 10 generally comprises a table 12 having a top surface 14. The table 12 has an offensive end 16 and a defensive end 18 positioned opposite the offensive end 16 for purposes of playing a game simulating American football. The table 12 may have a plurality of legs 20. The legs 20 may be adjustable in a conventional manner to allow positioning of the top surface 14 at a desired height to accommodate play by children or adults. Conventional adjusters may also be provided for leveling the top surface 14. A wall 22 is coupled to the table 12. The wall 22 extends upwardly from the top surface 14 and along the defensive end 18. The wall 22 may extend a full length around a perimeter edge 24 of the table 12. The wall 22 may also be either translucent or transparent to permit viewing of the top surface 14 through the wall 22 if desired. A slot 26 extends through the wall 22 extending along the defensive end 18 of the table 12.

A defensive handle 28 is coupled to and extends through the wall 22 along the defensive end 18 of the table 12. The defensive handle 28 has a first end 30 and a second end 32. The first end 30 is extended outwardly over the perimeter edge 24 of the table 12. The defensive handle 28 may have a gripping section 34 and an extension section 36. The gripping section 34 extends towards the extension section 36 from the first end 30 of the defensive handle 28. The gripping section 34 may be transverse to the extension section 36. A defensive player form 38 is coupled to the second end 32 of the defensive handle 28 such that the defensive player form 38 is selectively positionable between lateral sides 40 of the table 12 by manipulation of the defensive handle 28. The defensive player form 38 may be aligned substantially coplanar with the gripping section 34 of the defensive handle 28. The defensive player form 38 and the gripping section 34 extend from opposite sides of the extension section 36 of the defensive handle 28. The defensive player form 38 may be a figurine or other shape of a desired size designed to block a portion of the space between the lateral sides 40 of the table 12.

A slope 42 is coupled to the table 12. The slope 42 has a top end 44 and a bottom end 46. Each of a plurality of rollers 48 is coupled to the slope 42 wherein the slope 42 is moveable relative to the top surface 14 of the table 12. The slope 42 may be moved across the top surface 14. The slope 42 may also be pivotable relative to the rollers 48 such that the slope 42 is adjustable to extend at an angle towards a selectable one of the lateral sides 40 of the table 12. An offensive handle 50 is coupled to the slope 42 wherein manipulation of the offensive handle 50 selectively adjusts a position of the slope 42 relative to the top surface 14 of the table 12. A sled 52 is selectively couplable to the slope 42 wherein the sled 42 is slidable from the top end 44 of the slope 42 to the bottom end 46 of the slope 42 towards the defensive end 18 of the table 12. An offensive player form 54 is coupled to the sled 52. The offensive player form 54 may be a figurine showing a player in a running stance holding a football. A forward face of the offensive player form 54 is shaped to occupy a desired amount of space between the lateral sides 40 of the table 12. Thus, the sled 52 and offensive player form 54 may be released on the slope 42 and the position of the slope 42 adjusted in an attempt to have the offensive player form 54 move past a defined end line on the top surface 14 of the table 12 while an opposing player manipulates the defensive handle 28 attempting to block the offensive player form 54 with the defensive player form 38.

The sled 52 may employ structure to assist in retaining the sled 52 on the slope 42 as the sled 52 descends on the slope 42 simultaneous to manipulation of the positioning of the slope 42. A channel 56 may extend upwardly into the sled 52 from a bottom surface of the sled 52. The channel 56 may have a planar upper face 58 and a pair of side surfaces 60 extending downwardly and outwardly from opposite sides of the planar upper face 58. A plurality of bearings 62 may be coupled to the sled 52 to facilitate or quicken movement of the sled 52 down the slope 42. The bearings 62 may be positioned in the channel 56 wherein the bearings 62 facilitate sliding of the sled 52 along the slope 42. A weight 64 may be embedded in the sled 52. The weight 64 may be metallic and a magnet 66 may be coupled to the slope 42 wherein the magnet 66 attracts the weight 64 such that the sled 42 is inhibited from falling off of the slope 42 as the sled 52 slides along the slope 42 while the slope 42 is moved by manipulation of the offensive handle 50.

The device 10 may further include structure to require performance of a physical nature to simulate of a field goal or extra point. A cup 68 is positionable adjacent to the defensive end 18 of the table 12. The cup 68 has an upper opening 70 defining a target 72. A ball 74 is sized to fit through the target 72 and into the cup 68 wherein the ball 74 is projectable into the cup 68 from a distance. A goalpost 76 may be provided to enhance the challenging nature of the field goal or extra point simulation. The goalpost 76 is selectively couplable to the table 12 by insertion of a lower end 78 of the goalpost 76 into the top surface 14 of the table 12. The cup 68 is positioned between the goalpost 76 and the defensive end 18 of the table 12. The goalpost 76 may have spaced uprights 80 providing partial obstruction to the sides of the target 72 and defining a space therebetween through which the ball 74 must pass before entering the cup 68. The ball 74 may take the form of a ping pong ball, a weighted sack, or the like to be used depending on the location the game is played, such as outdoors or indoors, to provide an achievable yet challenging physical act to satisfy the requirements of scoring points according to rules of the game.

A bottom wall 82 may be coupled to the table 12 and positioned in spaced relationship under the upper surface 14 of the table 12. A cup aperture 84 extends through the upper surface 14 of the table 12. The cup 68 has an open bottom end 86 alignable with the cup aperture 84, or the cup 68 may be set into the cup aperture 84, wherein the ball 74 passes through the cup aperture 84 when the ball 74 passes through the cup 68. The bottom wall 82 catches the ball 74 and may be slanted wherein the ball 74 is gravitationally urged towards the offensive end 16 of the table 12 when the ball 74 falls upon the bottom wall 82. A lip 53 may be coupled to and extend upwardly from the bottom wall 82 proximate the offensive end 16 of the table 12 wherein the lip 53 retains the ball 74 on the bottom wall 82 along the offensive end 16 of the table 12 to be accessible to a player of the game. A shelf 88 may be coupled to the table 12 in a desired position to store the goalpost 76 and cup 68 until such time as a field goal or extra point simulation is attempted. The shelf 88 may be positioned on an underside 90 of the bottom wall 82 adjacent to the defensive end 18 of the table 12.

The table 12 may be provided with a plurality of spaced tracks 55. Each track 55 extends across the top surface 14 of the table 12. Each track 55 receives an associated one of the rollers 48 therein. A first one of the tracks 55A extends along the offensive end 16 of the table 12. A second one of the tracks 55B is positioned between the offensive end 16 of the table 12 and the defensive end 18 of the table 12. A groove 92 may extend laterally across the top surface 14 of the table 12. An associated one of the rollers 48 is seated in the groove 92. The groove 92 is positioned between the spaced tracks 55. Indicia 94 may be positioned on the top surface 14 of the table 12 simulating an American football field including an end zone. The end zone may be aligned with the bottom end 46 of the slope 42. A resilient stopper 96 may be positioned in the slot 26. The defensive handle 28 extends through the resilient stopper 96 wherein the resilient stopper 96 retains the defensive handle 28 in the slot 26. Each of a plurality of supports 98 has a top end 100 and a bottom end 102. The top end 100 of each support 98 is coupled to the slope 42. The bottom end 102 of each support 98 is coupled to an associated one of the rollers 48.

In use, the device 10 as described above permits play of a game simulating American football in which players alternate playing offense and defense by alternating positions at the offensive end 16 and defensive end 18 of the table 12. The sled 52 is positioned on the slope 42 and released such that the sled 52 moves towards the defensive end 18 of the table 12. The offensive handle 50 is manipulated to aim the sled 52 as desired. The defensive player manipulates the defensive handle 28 attempting to effectively block the path of the sled 52. Successfully blocking the sled 52 can result in the offensive player choosing to attempt a field goal simulated by throwing the ball 74 into the target 72 after the ball 74 passes through the goalposts 76. The game can be played for a set time, set number of possessions per team, first to attain a pre-determined score, or the like. The rules may varied or customized as desired to change the experience of playing the game.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. An American football simulating table game device comprising:

a table having a top surface, said table having an offensive end and a defensive end positioned opposite said offensive end;

a wall coupled to said table, said wall extending upwardly along said defensive end;

a slot extending through said wall, said slot extending along said defensive end of said table;

a defensive handle coupled to and extending through said wall along said defensive end of said table, said defensive handle having a first end and a second end, said first end being extended outwardly over a perimeter edge of said table;

a defensive player form coupled to said second end of said defensive handle wherein said defensive player form is selectively positionable between lateral sides of said table by manipulation of said defensive handle;

a slope having a top end and a bottom end, said slope being coupled to said table;

a plurality of rollers, each roller being coupled to said slope wherein said slope is moveable across said top surface of said table;

an offensive handle coupled to said slope wherein manipulation of said offensive handle selectively adjusts a position of said slope relative to said top surface of said table;

a sled selectively couplable to said slope wherein said sled is slidable from said top end of said slope to said bottom end of said slope towards said defensive end of said table; and an offensive player form coupled to said sled.

2. The device of claim 1, further comprising:

a channel extending upwardly into said sled, said channel having planar upper face and a pair of side surfaces extending downwardly and outwardly from opposite sides of said planar upper face; and a plurality of bearings coupled to said sled, said bearings being positioned in said channel wherein said bearings facilitate sliding of said sled along said slope.

3. The device of claim 1, further comprising:

a weight embedded in said sled, said weight being metallic; and a magnet coupled to said slope wherein said magnet attracts said weight such that said sled is inhibited from falling off of said slope as said sled slides along said slope while said slope is moved by manipulation of said offensive handle.

4. The device of claim 1, further comprising said wall extending a full length around said perimeter edge of said table.

5. The device of claim 1, further comprising said wall being transparent.

6. The device of claim 1, further comprising:

a cup positionable adjacent to said defensive end of said table, said cup having an upper opening defining a target;

a goalpost couplable to said table wherein said cup is positioned between said goalpost and said defensive end of said table; and a ball, said ball being sized to fit through said target and into said cup wherein said ball is projectable into said cup from a distance.

7. The device of claim 6, further comprising:

a bottom wall coupled to said table, said bottom wall being positioned in spaced relationship under said upper surface of said table;

a cup aperture extending through said upper surface of said table; and said cup having an open bottom end alignable with said cup aperture wherein said ball passes through said cup aperture when said ball passes through said cup, said bottom wall being slanted wherein said ball is gravitationally urged towards said offensive end of said table when said ball falls upon said bottom wall.

8. The device of claim 7, further comprising a lip coupled to and extending upwardly from said bottom wall proximate said offensive end of said table wherein said lip retains said ball on said bottom wall along said offensive end of said table.

9. The device of claim 7, further comprising a shelf coupled to said table, said cup and said goalpost being selectively positionable on said shelf for storage, said shelf being positioned on an underside of said bottom wall adjacent to said defensive end of said table.

10. The device of claim 1, further comprising:

a plurality of spaced tracks, each track extending across said top surface of said table, each track receiving an associated one of said rollers therein;

a first one of said tracks extending along said offensive end of said table; and a second one of said tracks being positioned between said offensive end of said table and said defensive end of said table.

11. The device of claim 1, further comprising:

a groove extending laterally across said top surface of said table; and an associated one of said rollers being seated in said groove.

12. The device of claim 11, further comprising said groove being positioned between said spaced tracks.

13. The device of claim 1, further comprising indicia positioned on said top surface of said table, said indicia simulating an American football field.

14. The device of claim 1, further comprising a resilient stopper positioned in said slot, said defensive handle extending through said resilient stopper wherein said resilient stopper retains said defensive handle in said slot.

15. The device of claim 1, further comprising said defensive handle having a gripping section and an extension section, said gripping section extending towards said extension section from said first end of said defensive handle, said gripping section being transverse to said extension section.

16. The device of claim 15, further comprising said defensive player form being aligned substantially coplanar with said gripping section of said defensive handle.

17. The device of claim 15, further comprising said defensive player form and said gripping section extending from opposite sides of said extension section of said defensive handle.

18. The device of claim 1, further comprising a plurality of supports, each said support having a top end and a bottom end, said top end of each said support being coupled to said slope, said bottom end of each said support being coupled to an associated one of said rollers.

19. An American football simulating table game device comprising:

a table having a top surface, said table having an offensive end and a defensive end positioned opposite said offensive end;

a wall coupled to said table, said wall extending upwardly along said defensive end, said wall extending a full length around said perimeter edge of said table, said wall being transparent;

a slot extending through said wall, said slot extending along said defensive end of said table;

a defensive handle coupled to and extending through said wall along said defensive end of said table, said defensive handle having a first end and a second end, said first end being extended outwardly over a perimeter edge of said table, said defensive handle having a gripping section and an extension section, said gripping section extending towards said extension section from said first end of said defensive handle, said gripping section being transverse to said extension section, said defensive player form being aligned substantially coplanar with said gripping section of said defensive handle, said defensive player form and said gripping section extending from opposite sides of said extension section of said defensive handle;

a defensive player form coupled to said second end of said defensive handle wherein said defensive player form is selectively positionable between lateral sides of said table by manipulation of said defensive handle;

a slope having a top end and a bottom end, said slope being coupled to said table;

a plurality of rollers, each roller being coupled to said slope wherein said slope is moveable across said top surface of said table;

an offensive handle coupled to said slope wherein manipulation of said offensive handle selectively adjusts a position of said slope relative to said top surface of said table;

a sled selectively couplable to said slope wherein said sled is slidable from said top end of said slope to said bottom end of said slope towards said defensive end of said table;

an offensive player form coupled to said sled;

a channel extending upwardly into said sled, said channel having planar upper face and a pair of side surfaces extending downwardly and outwardly from opposite sides of said planar upper face;

a plurality of bearings coupled to said sled, said bearings being positioned in said channel wherein said bearings facilitate sliding of said sled along said slope;

a weight embedded in said sled, said weight being metallic; and a magnet coupled to said slope wherein said magnet attracts said weight such that said sled is inhibited from falling off of said slope as said sled slides along said slope while said slope is moved by manipulation of said offensive handle.

a cup positionable adjacent to said defensive end of said table, said cup having an upper opening defining a target;

a goalpost couplable to said table wherein said cup is positioned between said goalpost and said defensive end of said table;

a ball, said ball being sized to fit through said target and into said cup wherein said ball is projectable into said cup from a distance;

a bottom wall coupled to said table, said bottom wall being positioned in spaced relationship under said upper surface of said table;

a cup aperture extending through said upper surface of said table, said cup having an open bottom end alignable with said cup aperture wherein said ball passes through said cup aperture when said ball passes through said cup, said bottom wall being slanted wherein said ball is gravitationally urged towards said offensive end of said table when said ball falls upon said bottom wall;

a lip coupled to and extending upwardly from said bottom wall proximate said offensive end of said table wherein said lip retains said ball on said bottom wall along said offensive end of said table;

a shelf coupled to said table, said cup and said goalpost being selectively positionable on said shelf for storage, said shelf being positioned on an underside of said bottom wall adjacent to said defensive end of said table;

a plurality of spaced tracks, each track extending across said top surface of said table, each track receiving an associated one of said rollers therein, a first one of said tracks extending along said offensive end of said table, a second one of said tracks being positioned between said offensive end of said table and said defensive end of said table;

a groove extending laterally across said top surface of said table, an associated one of said rollers being seated in said groove, said groove being positioned between said spaced tracks;

indicia positioned on said top surface of said table, said indicia simulating an American football field;

a resilient stopper positioned in said slot, said defensive handle extending through said resilient stopper wherein said resilient stopper retains said defensive handle in said slot;

a plurality of supports, each said support having a top end and a bottom end, said top end of each said support being coupled to said slope, said bottom end of each said support being coupled to an associated one of said rollers.

* * * * *